United States Patent [19]

Baughman

[11] 3,937,512

[45] Feb. 10, 1976

[54] GRAB-STICK FOR LITTER

[76] Inventor: Harold E. Baughman, P.O. Box 6506, Santa Rosa, Calif. 95406

[22] Filed: Apr. 9, 1975

[21] Appl. No.: 566,346

Related U.S. Application Data

[63] Continuation of Ser. No. 413,195, Nov. 6, 1973, abandoned.

[52] U.S. Cl. ..... 294/19 R; 294/50.9; 294/104

[51] Int. Cl.[2] ..... B25J 1/00

[58] Field of Search ..... 294/19 R, 50.6, 50.8, 50.9, 294/100, 104, 115

[56] References Cited

UNITED STATES PATENTS

| | | | |
|---|---|---|---|
| 663,628 | 12/1900 | Hiett | 294/50.9 |
| 2,469,865 | 5/1949 | Crow | 294/104 |
| 2,575,561 | 11/1951 | Payne | 294/19 R |
| 2,759,758 | 8/1956 | Yancey | 294/104 |
| 2,905,498 | 9/1959 | Lunde | 294/19 R |
| 3,369,834 | 2/1968 | Miles | 294/50.9 |

*Primary Examiner*—Evon C. Blunk
*Assistant Examiner*—Johnny D. Cherry
*Attorney, Agent, or Firm*—Snyder, Brown and Ramik

[57] ABSTRACT

A lightweight grab stick incorporates a hand grip with trigger pull action. The support column and swing leg are of channel form and the trigger rod is connected to a control link member. The tips of the support column and swing leg are flattened to provide gripper jaws. The control link member is pivoted at triangularly spaced points respectively to the support column, the trigger rod and a pull rod which is connected to the swing leg. The control link and swing leg are on opposite sides of the support column and the pull rod protects through the support column. A guide prevents lateral motion of the swing leg.

8 Claims, 3 Drawing Figures

FIG. 1.
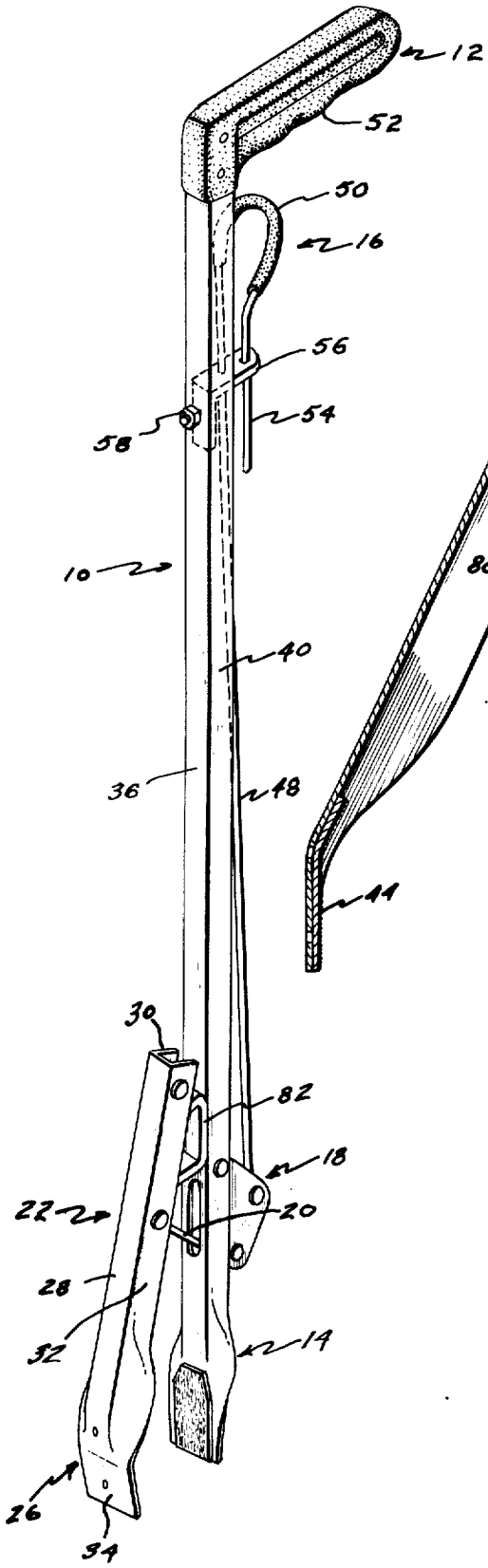
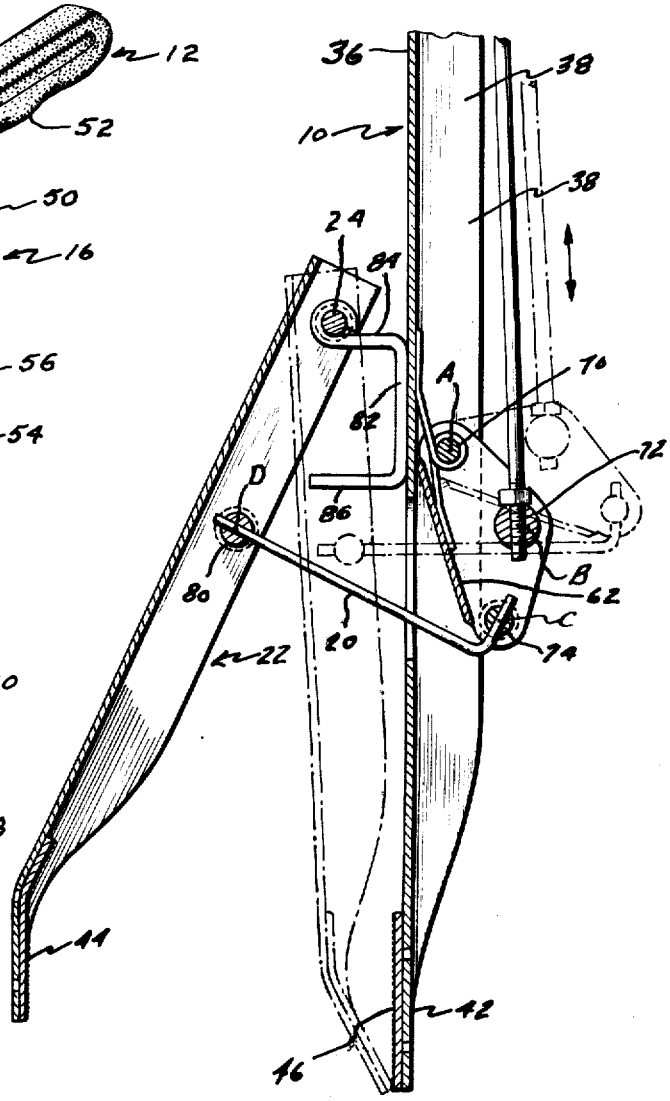
FIG. 3.
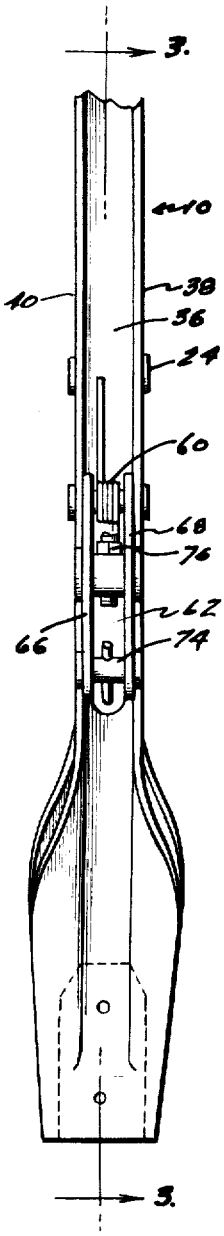
FIG. 2.

GRAB-STICK FOR LITTER

This is a continuation of application Ser. No. 413,195, filed Nov. 6, 1973, now abandoned.

BACKGROUND OF THE INVENTION

Grabsticks for picking up litter as used by personnel on public grounds such as state parks and the like should be capable of picking up a wide range of litter as for example jars and cans which represent rather large articles and ranging down to very small objects such as matches and the like. These devices should also be of lightweight construction and should require a minimum of physical effort on the part of the user firmly to grip the object being picked up and should otherwise be convenient to use and of effective and efficient operation.

BRIEF SUMMARY OF THE INVENTION

It is therefore of primary concern in connection with the present invention to provide an improved type of grab stick which is of light weight, is fully effective to pick up a wide range of litter and which incorporates a pistol grip type of action which makes the device easy to operate and to manipulate.

Essentially, the present invention incorporates a grab stick in which a support column is provided with a pistol grip type of member at its upper end and a trigger-like pull rod assembly which is characterized by its ease of action and firm gripping mechanical connection to the swing leg of the grab stick. The grab stick incorporates a channel-shaped support column in which the lower end of the column is flattened to provide a gripping jaw portion of large surface area. The swing leg is attached to the support column on the side opposite to the pistol grip and likewise is of channel configuration flattened at its end to provide the cooperative gripper jaw portion. A control link member is pivotally connected to the support column and has triangularly related pivotal connections respectively to the trigger pull rod, the support column and to a pull rod which projects through the support column into pivotal connection with the swing leg. The arrangement is detailed in design such that a spring acting between the support column and the control link member normally positions the swing leg in wide open position and causes the control link to seat against the support column. The triangular disposition of the pivot points effects a minimum of trigger movement between the full open and full closed positions of the gripper jaws and effects a positive gripping action.

BRIEF DESCRIPTION OF THE DRAWING FIGURES

FIG. 1 is a perspective view showing the preferred embodiment of grab stick according to the present invention;

FIG. 2 is a rear elevational view of the lower end of the grab stick as is indicated by section lines 2—2 in FIG. 1; and FIG. 3 is a longitudinal section of the assembly shown in FIG. 2 as indicated by the section lines 3—3 in FIG. 2.

DETAILED DESCRIPTION OF THE INVENTION

As will be seen by reference to FIG. 1, the grab stick according to the present invention consists essentially of a support column indicated generally by the reference character 10 and provided at its upper end with a laterally protecting pistol grip portion 12 and presenting at its lower end a gripper jaw portion 14. Associated with the pistol grip portion 12 is a trigger 16 which operates a control line 18 and the latter of which is connected through a pull rod 20 to the swing leg assembly indicated generally by the reference character 22. The swing leg assembly is pivotally connected at 24 to the support column and its lower end presents a gripper jaw portion 26 cooperative with the aforementioned gripper jaw portion 14 of the support column.

The swing leg 22 is of channel shaped configuration presenting the bight portion 28 and the parallel legs 30 and 32 and the gripper jaw portion 26 thereof is formed by flattening this channel configuration as shown so that its tip 34 presents a wide gripping jaw and is mildly curved as is evident from FIG. 3 so as to conform more readily to various objects to be picked up and to provide when closed a relatively narrow gripping area engagement with the gripper jaw portion of the support column.

The support column is also of channel configuration to present the bight 36 and the parallel legs 38 and 40 and it, too, is flattened at its lower end to present the gripper jaw portion 14, substantially as is shown. However, the flattened area of the gripper jaw portion 14 of the support column is of somewhat lesser axial length than is the flattened portion 34 of the swing leg so as to be of somewhat greater rigidity than is the gripper jaw portion of the swing leg. This permits the flattened gripper extremity or tip of the swing leg to flex flatwise against the gripper jaw tip 42 of the support column.

The opposed surfaces of the gripper jaw portions 14 and 26 preferably are provided with pads 44 and 46 of roughened, resilient material adhesively contacted thereto so as to provide for a firmer grip on the objects being picked up.

The trigger is in the form of an elongate rod 48 formed into a loop 50 at its upper end, which loop as well as the pistol grip portion 12 may be coated with resilient material 52, as shown. The pull rod 48 and the tip 54 of the trigger loop are guided within suitable openings in an L-shaped bracket 56 secured to the inner surface of the bight 36 of the support column and secured in place by a suitable fastener such as that indicated by the reference character 58. The lower extremity of the trigger pull rod 48 is pivotally connected to the control link 18 and the pivotal connections between the control link 18 and the support column 10, between the control link 18 and the trigger pull rod 48, and between the control link 18 and the pull rod 20 are, as indicated by reference characters A, B and C disposed in triangular relation. These pivot points and the lengths of the pull rod 20 in conjunction with the location of the pivot point 24 of the swing leg 22 are detailed in design so that in the full line position shown in FIG. 3 which is the extremity of swing leg opening position, a line passing through the points A and B is at an angle of not more than 135° with respect to the axis of the support column 10 and such that when the trigger rod is fully retracted, a line passing through the pivot point C and the pivot point D between the other extremity of the pull rod 20 and the swing leg 22 lies closely adjacent to the pivot point A, in which position the gripper jaws will be firmly interengaged. This arrangement allows a powerful gripping action throughout the range of operation and, at the same time, achieves this through a minimum of travel of the trigger assembly.

A torsion spring 60 is disposed in the bights 36 and 62 of the support column 10 and the control link 18 normally to urge the swing leg 22 to the full open position as is shown in FIG. 3.

The control link preferably is constructed of a deep channel member whose legs 66 and 68 are essentially triangularly shaped and which are disposed between the legs 38 and 40 of the support column in close adjacency to the inner sides thereof as shown in FIG. 2. The control link is fastened pivotally between legs 38 and 40 of the support column by a member 70, which in the preferred embodiment comprises a pivot pin which passes through apertures in legs 66 and 68, is suitably widened at the outer edges of the support column legs 38 and 40, and around the central portion of which pin is wrapped the coil of the torsion spring 60. Two other pivotal members 72 and 74 receive the respective ends of the trigger rod 48 and the pull rod 20 and pivotally connect them to the control link. The member 72 is provided with a transverse smooth bore receiving the end of the trigger pull rod 48 in a slip fit. Member 48 is secured in place by means of an end cap screw and/or an allen head set screw. The pivot member 74 is provided with a smooth transverse bore to receive the end of the pull rod 20 in a "slip" fit. The pull rod 20 may be secured in said bore by means such as a set-screw provided in one end of the pivot member 74 located along its main axis. A similar type of connection member 80 is provided for the opposite end of the pull rod 20. In any event, in the preferred embodiment, the opposite ends of the member 74 effect a stop action against the edges of the legs 38 and 40 to establish the wide open position of the swing arm 22 as reflected by the spring 60 so that the control link member 18 normally bears against the support column under the action of the spring 60.

A member 82 suitably mounted on the support column 10 provides both mounting for the swing leg 22 and guidance for said leg during use so as to avoid significant lateral motion thereof. The member 82 in the preferred embodiment comprises a short channel-shaped member, the upper leg 84 of which has been curved around the pivot pin 24 in the swing leg 22, providing mounting of the swing leg in an offset relationship sufficiently far from bight 36 so as to allow the gripper jaw portions 34 and 42 to engage in the fully closed position. The member 82 is slightly less wide than the distance between the legs 30 and 32 of the swing leg, and the lower leg 66 of said member forms a finger-like projection which is straddled by flanges 30 and 32 of the swing leg 22 to provide a guide for limiting motion of said swing leg perpendicular to its intended plane of motion. The position of the finger guide 86 near the pivot 24 allows effective function of the guide throughout the swing of the swingleg 22 in spite of the limitation in length imposed on the guide 86 by the necessity of allowing complete closure of gripper jaw portions 34 and 42. The leading edge of the finger guide 86 may be suitably curved or faceted so as to provide smooth engagement of the swing leg 22 around the guide 86 as closing is initiated from a fully open position.

What is claimed is:

1. A grab stick for picking up litter comprising in combination an elongated support column having a laterally projecting hand grip portion at its upper end and a gripper jaw portion at its lower end, an elongated swing leg pivotally connected at its upper end by a first pivot to said support column on that side thereof opposite to said hand grip portion and adjacent a lower end of said support column, said elongated swing leg having a gripper jaw portion at its lower end for swinging toward and away from the gripper jaw portion of said support column between respective closed and opened clamping positions, a control link member pivotally connected at one end thereof by a second pivot to said support column on that side of the support column from which said hand grip portion projects, a pull rod projecting through said support column and pivotally connected by a respective third and fourth pivots at its opposite ends to said swing leg and to said control link member, a trigger rod pivotally connected by a fifth pivot to said control link member between said second and fourth pivots and extending therefrom to terminate in a finger grip immediately below said hand grip portion, spring means for swinging said swing leg normally to its opened position to seat said control link member against said support rod, imaginary lines between said second and third pivots, said second and fourth pivots and said third and fourth pivots in said opened position of said gripper jaw setting-off a triangle of a predetermined height as measured by an imaginary line from said second pivot normal to the imaginary line between said third and fourth pivots, and said predetermined height being appreciably lessened in said closed position of said gripper jaw whereby said second, third and fourth pivots are brought closer to linear alignment to produce high clamping force in response to trigger rod movement.

2. The grab stick as defined in claim 1 wherein said support column and said swing leg each are of channel configuration and wherein the gripper jaw portion of each constitutes a flattened portion of such channel configuration.

3. The grab stick as defined in claim 2 wherein the channel configuration of said support column presents a bight and a pair of legs, and said control link member is pivotally connected to said support column between said legs.

4. The grab stick as defined in claim 3 wherein the pivotal connection at the fourth pivot between said pull rod and said control link member provides a stop to limit the open position of said swing leg with respect to said support column.

5. The grab stick as defined in claim 4 wherein said control link member comprises a channel-shaped member with legs which are essentially triangularly shaped and said second, fourth and fifth pivots being disposed essentially at the apices thereof.

6. The grab stick as defined in claim 1 wherein said support column is of channel configuration presenting a bight and a pair of legs, and said control link member being pivotally connected at said second pivot to said support column between said legs.

7. The grab stick as defined in claim 1 wherein the pivotal connection at the fourth pivot between said pull rod and said control link member provides a stop to limit the opened position of said swing leg with respect to said support column.

8. The grab stick as defined in claim 7 wherein said control link member comprises a channel-shaped member with legs which are essentially triangularly shaped and said second, fourth and fifth pivots being disposed essentially at the apices thereof.

* * * * *